United States Patent [19]

Kornatowski et al.

[11] 4,146,294

[45] Mar. 27, 1979

[54] LIGHT SOCKET WITH PLUNGER CONTACTS

[75] Inventors: Boleslaw Kornatowski, Elizabeth; Terry L. Wilson, Denville, both of N.J.

[73] Assignee: The Singer Company, New York, N.Y.

[21] Appl. No.: 879,980

[22] Filed: Feb. 22, 1978

[51] Int. Cl.[2] ..... H01R 13/46

[52] U.S. Cl. ..... 339/208; 339/88 R; 339/255 R

[58] Field of Search ..... 339/255 R, 255 B, 88 R, 339/88 C, 190, 210 T, 206 R, 206 L, 206 P, 207 R, 207 S, 208

[56] References Cited

FOREIGN PATENT DOCUMENTS 115898 11/1917 United Kingdom ..... 339/254 R 1146106 3/1969 United Kingdom ..... 339/88 R

*Primary Examiner*—Gerald A. Dost

*Attorney, Agent, or Firm*—Robert E. Smith; Edward L. Bell; Edward W. Goodman

[57] ABSTRACT

A contact assembly which includes a contact holder having means integral therewith for electrically terminating a lead wire. A contact element is slidably disposed in the contact holder and includes an outwardly protruding tang for engaging a closed slot in the contact holder thereby retaining the contact element in the contact holder.

2 Claims, 4 Drawing Figures

LIGHT SOCKET WITH PLUNGER CONTACTS

BACKGROUND OF THE INVENTION

This invention relates to light sockets, and more particularly, to those sockets adapted to receive bayonet-type lamps.

There are many bayonet-type light sockets having movable spring biased contacts. An example of this type light socket may be had in U.S. Pat. No. 2,739,198 of Happe et al. A common problem incurred with these devices is the difficulty to manufacture the device. Several parts must be machined to relatively close tolerances raising the cost thereof.

SUMMARY OF THE INVENTION

The object of this invention is to provide a light socket that may be easily assembled using inexpensive materials. This is accomplished by using a molded housing formed of two identical halves in combination with a snap-together contact assembly. The contact assembly is formed from sheet metal and includes a tubular contact holder having a wire terminating portion closing one end, and a tubular contact element slidably disposed in the contact holder. A tang is formed in the side of the contact element and, when the contact element is forcibly inserted into the contact holder, engages a slot formed in the contact holder, retaining the contact element therein.

DESCRIPTION OF THE DRAWING

With the above and additional objects and advantages in view as will hereinafter appear, the invention will be described with reference to the drawing of the preferred embodiment in which.

DESCRIPTION OF THE PREFERRED EMBODIMENT

Figure 1:
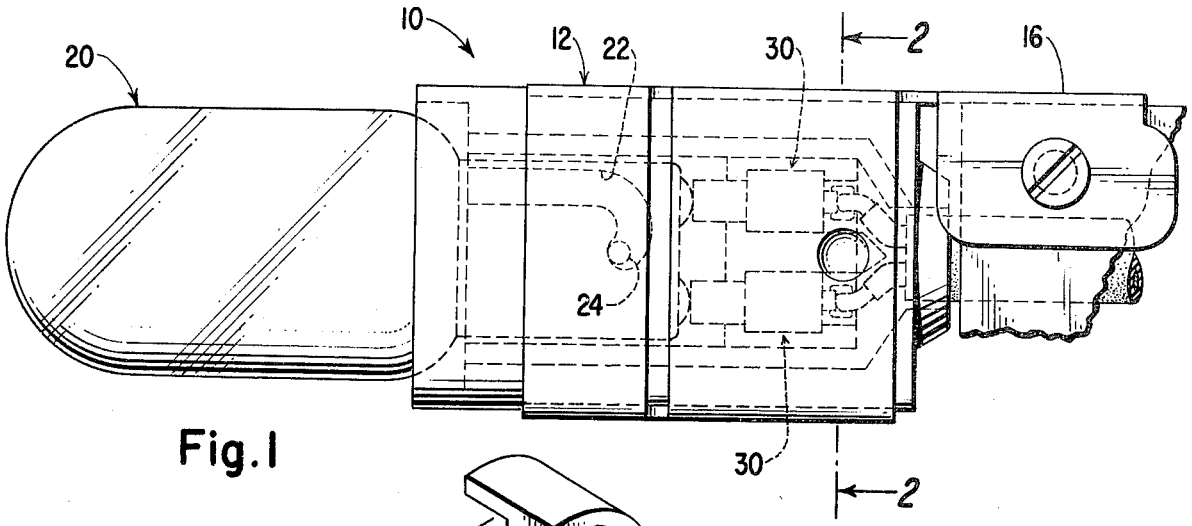
FIG. 1 is a top plan view of a light socket showing the contacts of this invention incorporated therein.
Figure 4:
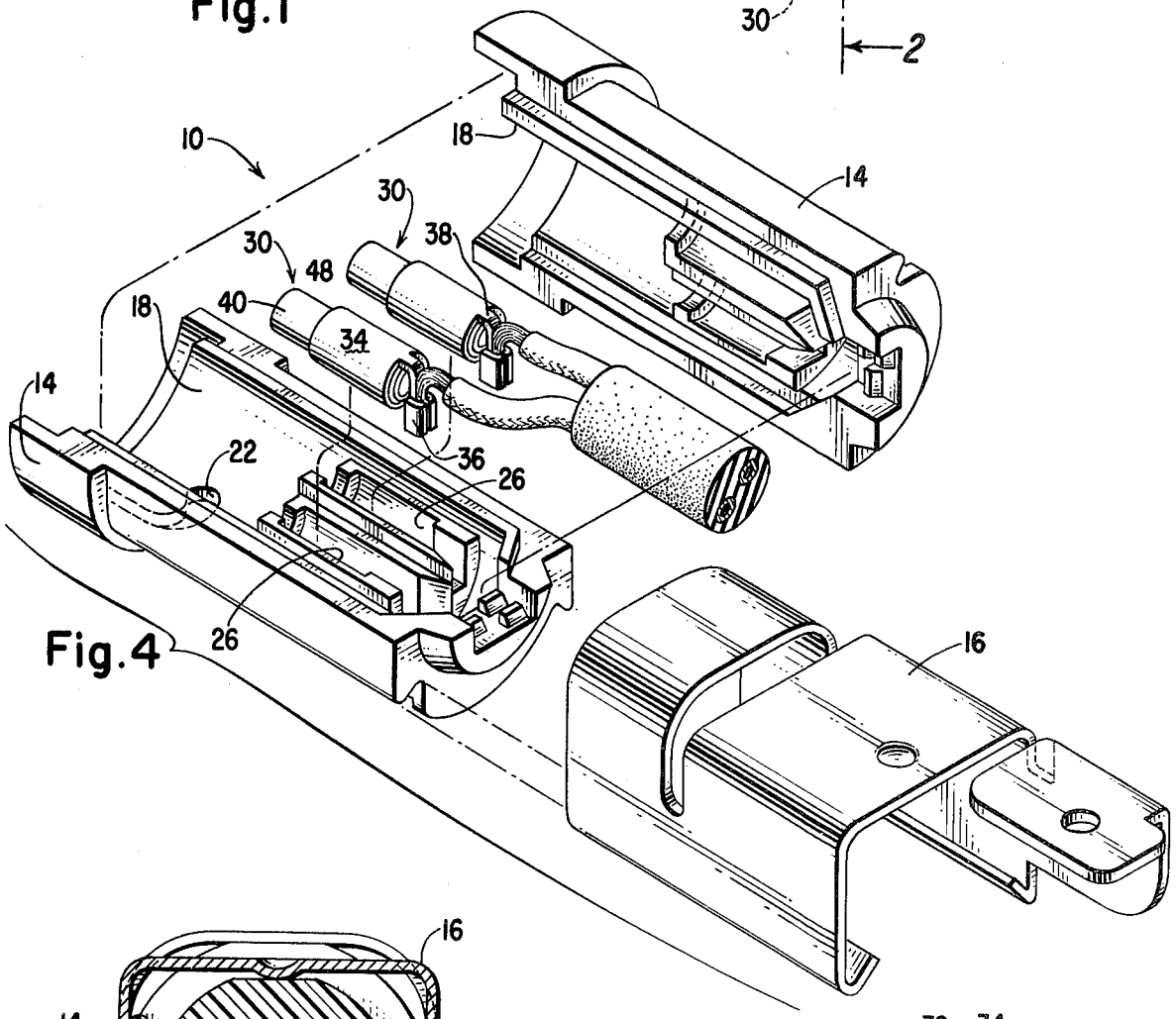
FIG. 4 is an exploded perspective view of the light socket.
Figure 2:
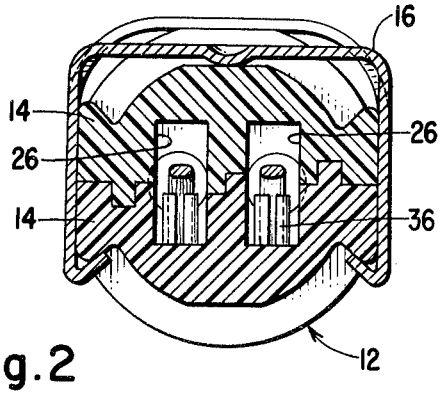
FIG. 2 is a cross-sectional view of the light socket taking along the line 2—2 of FIG. 1 showing the cavities which nest the contacts.
Figure 3:
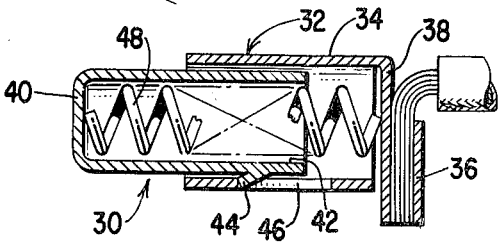
FIG. 3 is a detailed cross-sectional view of the contact of the invention.

Referring to FIG. 1, a light socket is generally referred to by the reference number 10. The socket 10 includes a housing 12 having two identical halves 14. A mounting bracket 16 is used both to mount the socket 10 and to secure the two housing halves 14 together. Each housing half 14 is formed with a longitudinal cavity 18 for receiving a bayonet-type lamp 20. The cavity 18 is further formed with a "J" shaped groove 22 therein for receiving the locking pins 24 protruding from the base of the lamp 20. Adjacent the cavity 18 are a pair of recesses 26 for receiving the contact assemblies 30 of this invention.

The contact assembly 30 includes a contact holder 32 formed from sheet metal. The contact holder 32 has a tubular shaped contact receiving end 34 and a "U" shaped wire termination end 36 joined by a narrow strip 38. After formation the strip 38 along with the wire termination end 36 may be folded beneath the contact receiving end 34 effectively closing one end thereof. Also included in the contact assembly 30 is a contact element 40. The contact element 40, which also may be formed from sheet metal, is hollow having an opening 42 in one end thereof and is slidably disposed in the contact receiving end 34 of the contact holder 32. A tang 44 is formed in the side of the contact element 40 near the open end 42 thereof and depends on the contact element 40 in a direction away from the open end 42, to allow the contact element 40 to be inserted into the contact holder 42, which, in turn, is formed with a closed longitudinal slot 46 in the side of the contact receiving end 34 for receiving the tang 44. A compression spring 48 is inserted in the contact receiving end 34 of the contact holder 32 between the strip 38 and the contact element 40 urging the contact element 40 out of the contact receiving end 34 until the tang 44 engages the end of the slot 46.

Numerous alternations are the structure herein disclosed will suggest themselves to those skilled in the art. However, it to be understood that the present disclosure relates to a preferred embodiment of the invention which is for the purposes of illustration only and not to be construed as a limitation of the invention. All such modifications which do not depart from the spirit of the invention are intended to be included within the scope of the appended claims.

I claim:

1. A contact assembly for a light socket comprising: a hollow open ended tubular contact holder, said contact holder being formed of an electrically conductive material and having a closed longitudinal slot formed in the side thereof; a tang integral with and bent transversely across said tubular contact holder for closing one end thereof; means for electrically attaching a lead wire to said contact holder tang; a hollow electrically conductive contact element having a closed end and an open end, said contact element slidably disposed in said contact holder with the open ends of said contact element and contact holder in communication, said contact element being formed with a protuberance on the side thereof, said protuberance joined to said contact element adjacent said open end thereof and projecting angularly outwardly in the direction of the closed end thereof for engaging the slot in said holder thereby retaining said contact element in said holder with said contact element partially protruding through the open end of said contact holder; and a coil spring arranged within both said contact holder and said contact element and extending between the closed ends thereof for urging said contact element through the open end of said contact holder.

2. The contact assembly as set forth in claim 1 in combination with a socket housing comprising two identical housing halves, each of said housing halves being formed with a lamp recess for collectively receiving said lamp and a pair of contact recesses adjacent the end of said lamp recess for receiving a pair of said contact assemblies; and means for fastening said housing halves together.

* * * * *